US007330200B2

(12) United States Patent
Vanous

(10) Patent No.: US 7,330,200 B2
(45) Date of Patent: Feb. 12, 2008

(54) THERMAL PROCESSOR EMPLOYING REPLACEABLE SLEEVE

(75) Inventor: James C. Vanous, Roseville, MN (US)

(73) Assignee: Carestream Health, Inc., Rochester, NY (US)

( * ) Notice: Subject to any disclaimer, the term of this patent is extended or adjusted under 35 U.S.C. 154(b) by 105 days.

(21) Appl. No.: 11/029,593

(22) Filed: Jan. 5, 2005

(65) Prior Publication Data

US 2006/0146111 A1 Jul. 6, 2006

(51) Int. Cl.
*G03D 13/00* (2006.01)
*G03G 15/06* (2006.01)

(52) U.S. Cl. ..... 347/140; 355/27

(58) Field of Classification Search ..... 347/140, 347/228; 355/27

See application file for complete search history.

(56) References Cited

U.S. PATENT DOCUMENTS 3,757,662 A * 9/1973 Ingels ..... 219/216
3,807,616 A 4/1974 Hope et al.
4,178,664 A * 12/1979 McLoughlin ..... 492/56
4,992,816 A 2/1991 Nakamura et al.
5,066,562 A 11/1991 Nakamura
5,091,281 A 2/1992 Nakamura et al.
5,296,874 A 3/1994 Nagata et al.
5,468,568 A * 11/1995 Kuhn et al. ..... 428/35.9
5,946,025 A 8/1999 Allen
6,007,971 A 12/1999 Star et al.
6,285,006 B1 9/2001 Hyllberg
6,393,249 B1 * 5/2002 Aslam et al. ..... 399/333
6,541,171 B1 * 4/2003 Chowdry et al. ..... 430/58.65
6,567,641 B1 * 5/2003 Aslam et al. ..... 399/330
6,582,222 B1 * 6/2003 Chen et al. ..... 432/60
2002/0135657 A1 * 9/2002 Sumi et al. ..... 347/140
2004/0136707 A1 7/2004 Sumi et al.

* cited by examiner

*Primary Examiner*—Huan Tran

(57) ABSTRACT

A thermal processor for thermally developing an image in an imaging material. The processor includes an oven, at least one rotatable member positioned within oven, and a sleeve adapted to slideably fit over and selectively couple to at least a portion of the rotatable member. The sleeve has an exterior surface coated with a layer of polymer material and is positioned such that the layer of polymer material contacts and transports the imaging material through the oven as the at least one rotatable member rotates.

15 Claims, 7 Drawing Sheets

THERMAL PROCESSOR EMPLOYING REPLACEABLE SLEEVE

FIELD OF THE INVENTION

The present invention relates generally to an apparatus and method for thermally processing an imaging media, and more specifically to an apparatus and method for thermally developing an imaging media employing a replaceable sleeve positioned about a rotatable member.

BACKGROUND OF THE INVENTION

Photothermographic film generally includes a base material, such as a thin polymer or paper, typically coated on one side with an emulsion of dry silver or other heat sensitive materials. Once the film has been subjected to photostimulation (exposed), for example, by light from a laser of a laser imaging system, the resulting latent image is developed through application of heat to the film. To produce a high quality image, controlling heat transfer to the photothermographic film during the development process is critical. If heat transfer is not uniform, visual artifacts such as non-uniform density and streaking may occur.

Several types of thermal processors have been developed in efforts to achieve optimal heat transfer to exposed photothermographic film during processing. One type employs a rotating heated drum having multiple pressure rollers positioned around a segment the drum's circumference to hold the film in contact with the heated drum during development. Another type of processor, commonly referred to as a flat-bed processor, employs multiple transport rollers spaced to form a generally horizontal transport path that moves the photothermographic film through an oven. Both the heated drum and the transport rollers of the flatbed processor have surfaces which may be coated with a thin polymer coating which contacts and assists in transporting the photothermographic film through the processor during development.

As the photothermographic is heated during development, some types of emulsions produce gases that include contaminants which can condense and become deposited on surfaces within the processor. Over time, these and other contaminants can accumulate on the polymer-coated surfaces of the drums and rollers and potentially cause visual defects in the developed image. Consequently, the processors require regular cleaning to remove such deposits from the surfaces of the drums and rollers.

During the cleaning process, a qualified technician generally applies solvents to the surfaces of the drums and rollers to dissolve and remove the deposits. However, due to inherent variations in such a procedure, one portion of the surface of a drum or roller may be more thoroughly cleaned than another portion of the surface during a single cleaning process, and the thoroughness of the cleaning may vary from one cleaning process to the next. Such variations in the cleaning process can result in inconsistencies in the quality of the images produced by the thermal processors. Such a cleaning process can be also be costly and result in processor downtime, and solvents employed in the cleaning process sometimes produce undesirable odors, resulting in complaints from customers and technicians alike. Furthermore, in situations where an entire drum is replaced, associated heaters must be recalibrated in order to operate properly.

It is evident that there is a need for improving thermal processors, particularly drum type processors, to reduce problems associated with routine maintenance.

SUMMARY OF THE INVENTION

In one embodiment, the present invention provides a thermal processor for thermally developing an image in an imaging material, the thermal processor including an oven and at least one rotatable member positioned within the oven. A sleeve is adapted to slidably fit over and selectively couple to at least a portion of the rotatable member, the sleeve having an exterior surface coated with a layer of polymer material. The sleeve is positioned such that the layer of polymer material contacts the imaging material and transports the imaging material through the oven as the at least one rotatable member rotates.

In one embodiment, the present invention provides a thermal processor including an enclosure forming an oven, a heated drum for thermally developing an image in an imaging media, wherein the heated drum positioned at least partially within the oven, and a drive system for rotating the heated drum. The thermal processor further includes a tubular sleeve adapted to slidably fit over and selectively couple to at least a portion of an outer surface of the heated drum. The tubular sleeve has an exterior surface substantially coated with a polymer material and is positioned such that the polymer material contacts and transports the imaging media through the oven as the heated drum rotates.

By providing a removable sleeve coated with a layer of polymer material, the layer of polymer material can be replaced upon becoming contaminated with byproducts released by the imaging media during development by installing a new sleeve. Installation of a new sleeve eliminates problems associated with cleaning the integral polymer surfaces of standard processing drums, such as image defects resulting from nearly inherent variations in the cleanliness of the polymer material after cleaning and undesirable odors associated with cleaning solvents. Furthermore, replacement of the sleeve can be completed more quickly than cleaning the integral polymer surfaces of standard processor drums, thereby reducing labor associated with maintenance and processor downtime. Also, since the drum is not being replaced, calibration of associated heaters is not required.

BRIEF DESCRIPTION OF THE DRAWINGS

The foregoing and other objects, features, and advantages of the invention will be apparent from the following more particular description of the embodiments of the invention, as illustrated in the accompanying drawings. The elements of the drawings are not necessarily to scale relative to each other.

DETAILED DESCRIPTION OF THE INVENTION

Figure 1:
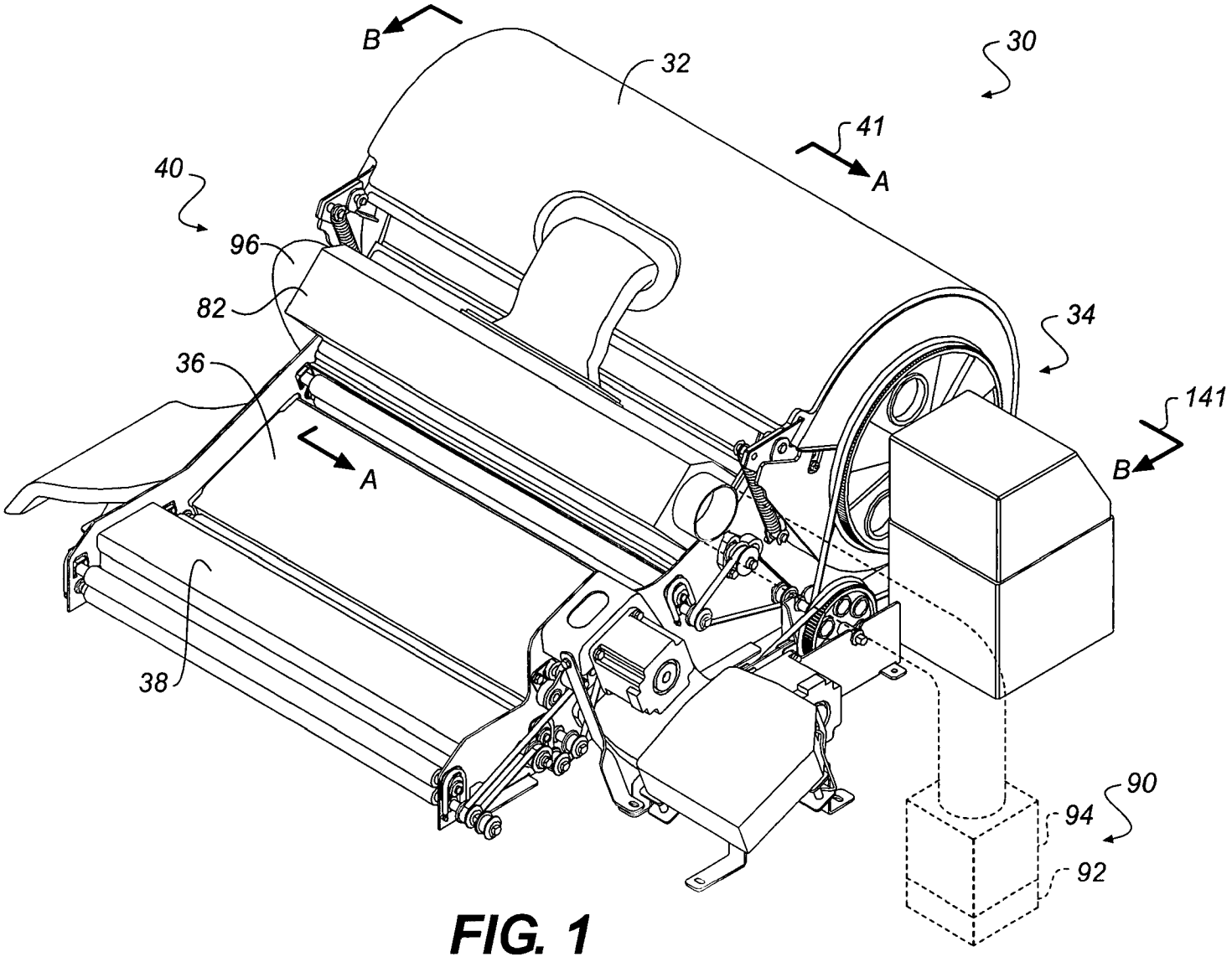
FIG. 1 is a perspective view illustrating generally a thermal processor employing a replacement sleeve in accordance with the present invention.

FIG. 1 is a perspective view illustrating generally a drum type thermal processor 30 including a heated drum assembly 32 employing a replaceable outer sleeve in accordance with the present invention. Thermal processor 30 further includes a drive system 34, a film cooling section 36, a densitometer 38, and a contaminant removal system 40. In operation, exposed photothermographic media is thermally developed by heated drum assembly 32. The heated media is cooled while passing over cooling section 36. Densitometer 38 reads density control patches on the developed media before the developed media is output to a user. Contaminant removal system 40 is configured to remove airborne contaminants, including heated gasses, produced during the thermal development process from heated drum assembly 32.

Figure 2:
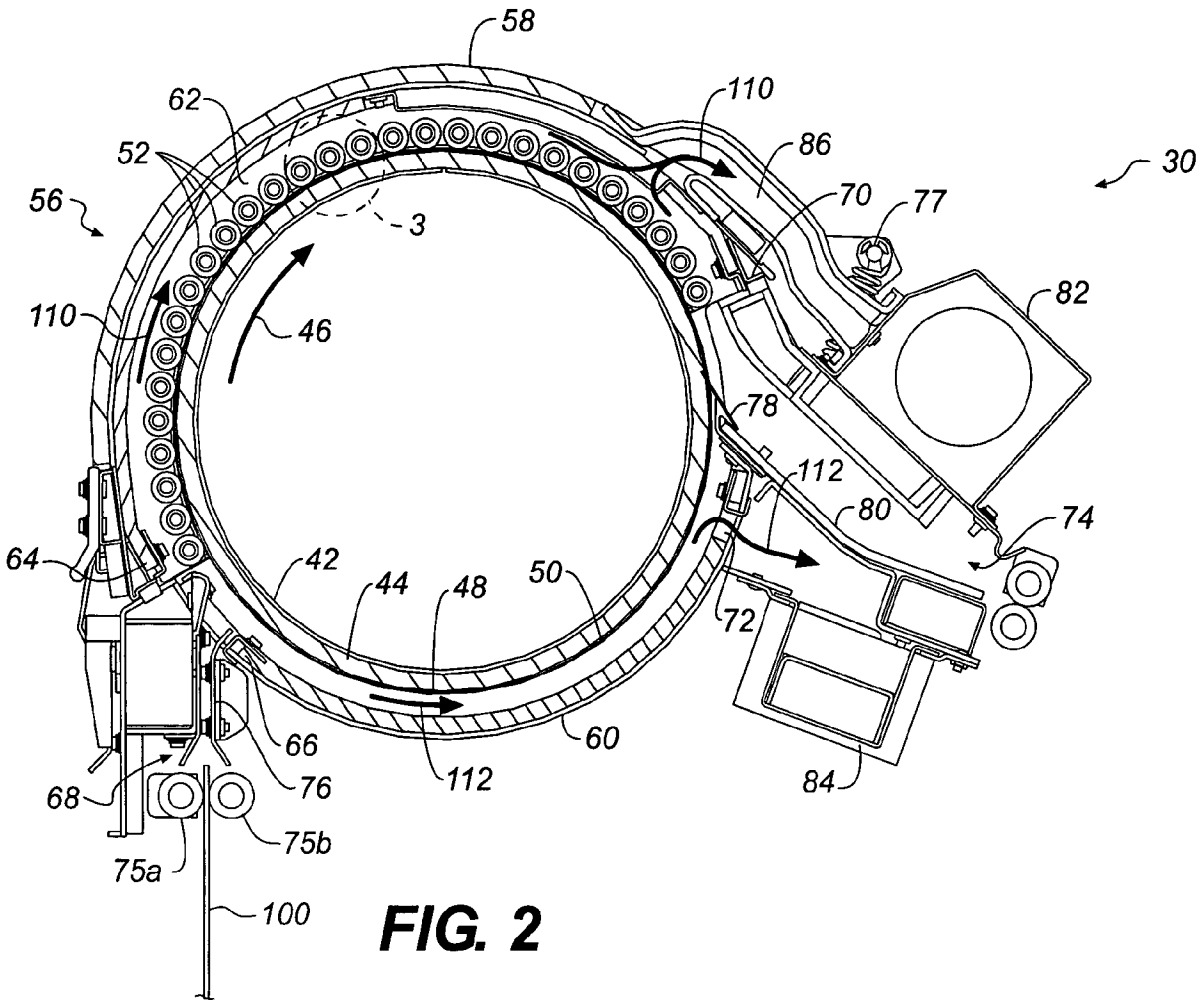
FIG. 2 is a lateral cross-sectional view illustrating in greater detail portions of the thermal processor of FIG. 1.

FIG. 2 is a cross-sectional view, as indicated by section line A-A at 41 in FIG. 1, illustrating in greater detail portions of thermal processor 30. Heated drum assembly 32 includes a circumferential heater 42 mounted within an interior of a rotatable processor drum 44 which is coupled to and driven in a direction 46 by drive assembly 34. A replaceable tubular sleeve 48 having an exterior surface coated with a layer 50 of a polymer material is fitted about the exterior of and is selectively coupled to processor drum 44 in accordance with the present invention. Tubular sleeve 48 rotates along with processor drum in direction 46. A plurality of pressure rollers 52 is circumferentially arrayed about a segment of drum 44 and tubular sleeve 48, and is configured to hold an exposed media in contact with layer 50 of tubular sleeve 48 during the development process.

Figure 3:
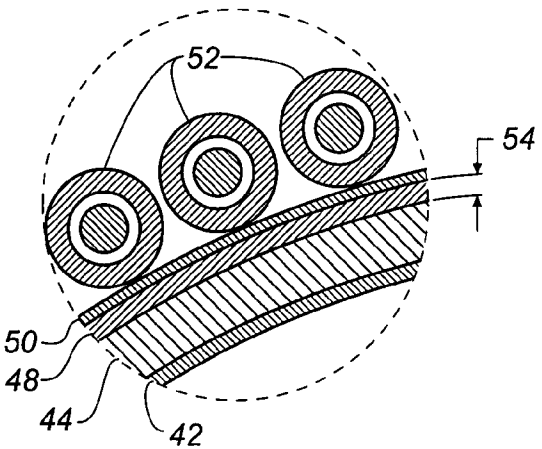
FIG. 3 is a longitudinal cross-sectional view illustrating in greater detail portions of the thermal processor illustrated by FIG. 1.

FIG. 3 is an enlarged view of portions of thermal processor 30 of FIG. 2 more clearly illustrating circumferential heater 42, processor drum 44, tubular sleeve 48, polymer material layer 50, and pressure rollers 52. In one embodiment, sleeve 48 comprises a seamless tubular sleeve to eliminate potential surface inconsistencies in polymer material layer 50 that could result in artifacts in the developed image. In one embodiment, polymer material layer 50 comprises a silicone rubber material.

To provide sufficient heat transfer from circumferential heater 42 to polymer material layer 50, tubular sleeve 50 comprises a material having high thermal conductivity characteristics. In one embodiment, tubular sleeve 48 comprises a metallic material, such as nickel. In order to improve heat transfer from processor drum 44 to polymer material layer 50, the wall thickness 54 of tubular sleeve 48 should be as thin as possible. However, the wall thickness 54 of tubular sleeve 48 must also be able to provide structural stability to tubular sleeve 48 so that it can be handled and installed without damage. Thus, in one embodiment, tubular sleeve has a wall thickness 54 sufficiently thin to enable heat transfer from the heated drum 44 to polymer material layer 50 to develop imaging media and sufficiently thick to provide structural stability. In one embodiment, tubular sleeve 48 has wall thickness 54 of about 0.005 inches. Further embodiments of tubular sleeve 48 are described below by FIGS. 4-5.

Returning to FIG. 2, thermal processor 30 further includes an enclosure 56 having an upper curved cover 58 spaced from pressure roller 52 and a lower curved cover 60 spaced from a lower portion of drum 44 that encloses and forms an oven 62 around drum 44, tubular sleeve 48, and pressure rollers 52. Upper and lower covers 58 and 60 have respective first ends 64 and 66 spaced from one another to define a media (film) entrance region 68, and respective second ends 70 and 72 forming a media (film) exit region 74. Entrance region 68 includes a pair of feed rollers, 75*a* and 75*b*, and a media guide 76. Upper cover 58 can be rotated around a hinge 77 so that enclosure 56 can be opened to allow access to drum 44, tubular sleeve 48, and pressure rollers 52. A film diverter 78 diverts film from contact with layer 50 of tubular sleeve 48 to exit region 74 over a perforated felt pad 80.

An upper condensation trap 82, lower condensation trap 84, and duct 86 form a portion of contaminant removal system 40. As illustrated by the dashed lines in FIG. 1, contaminant removal system 40 further includes a vacuum system 90 coupled to upper condensation trap 82 and including a fan 92 and a filter 94. A hose 96 connects lower condensation trap 84 to upper condensation trap 82. A contaminant removal system similar to that described above is described by U.S. patent application Ser. No. 10/376,547 entitled "Contaminant Removal System in a Thermal Processor", which is assigned to the same assignee as the present application and is herein incorporated by reference.

During operation, circumferential heater 42 heats drum 44 and tubular sleeve 48 to a temperature necessary to provide a uniform development temperature to the imaging media being developed. For photothermographic medical film, for example, drum 44 and tubular sleeve 48 operate at a temperature of approximately 122.5° C. Feed rollers 75 receive and feed a piece of exposed imaging media, such as imaging media 100, to media guide 76 which channels imaging media 100 to drum 44 and sleeve 48. As exposed imaging media 100 contacts polymer layer 50, the rotation of drum 44 and sleeve 48 draws exposed imaging media under pressure rollers 52 and transfers exposed imaging media 100 from entrance region 68 to exit region 74. As imaging media 100 reaches exit region 74, film diverter 78 directs imaging media 100 from polymer layer 50 to cooling region 36.

As imaging media 100 wraps around tubular sleeve 48 and is transported toward exit region 74, imaging media 100 begins to be heated to the desired development temperature. Photothermographic film, such as imaging media 100, generally comprises a base material, such as a thin polymer or paper, which is typically coated on one side with an emulsion of heat sensitive materials. To obtain a more uniform development temperature, the emulsion side of imaging media 100 is in contact with polymer layer 50 of tubular sleeve 48. As the emulsion is heated, it produces gasses containing contaminants, fatty acids (FAZ) in particular, which may subsequently condense and collect on surfaces within enclosure 56.

In efforts to remove these contaminants, vacuum system 90 draws air into oven 62 from entrance region 68 and produces upper and lower air streams 110 and 112 around drum 44 and tubular sleeve 48. Upper air stream 110 is drawn into upper condensation trap 82 via duct 86 and lower air stream 112 is drawn in lower condensation trap 84, wherein the gasses are mixed with ambient air and subsequently condense.

While contaminant removal system 40 is effective at removing contaminants, at least some of the contaminants produced by the emulsion during the development process remain within enclosure 48. Over time, these contaminants collect on surfaces within enclosure 64, particularly polymer layer 50 of tubular sleeve 48 which is in direct contact with the emulsion, and can result in damage to processor components and in visual defects in developed image of imaging media 100. Consequently, regular maintenance is required to remove accumulated contaminants from thermal processor 30.

Unlike standard thermal processors, however, which require a qualified technician to manually clean the integral polymer surfaces of standard processing drums, a technician maintaining thermal processor 30 according to the present invention simply removes and replaces a used tubular sleeve 48 with a new tubular sleeve 48. Thus, tubular sleeve 48 of thermal processor 30 in accordance with the present invention, substantially eliminates potential image defects resulting from variations in the cleaning process and reduces and/or eliminates the occurrence of undesirable side effects associated with use of cleaning solvents. Furthermore, replacement of tubular sleeve 48 can be completed more quickly than cleaning the integral polymer surfaces of standard processor drums, thereby reducing labor associated with maintenance and processor downtime. Also, since process drum 44 s not being replaced, calibration of associated heaters is not required.

Figure 4A:
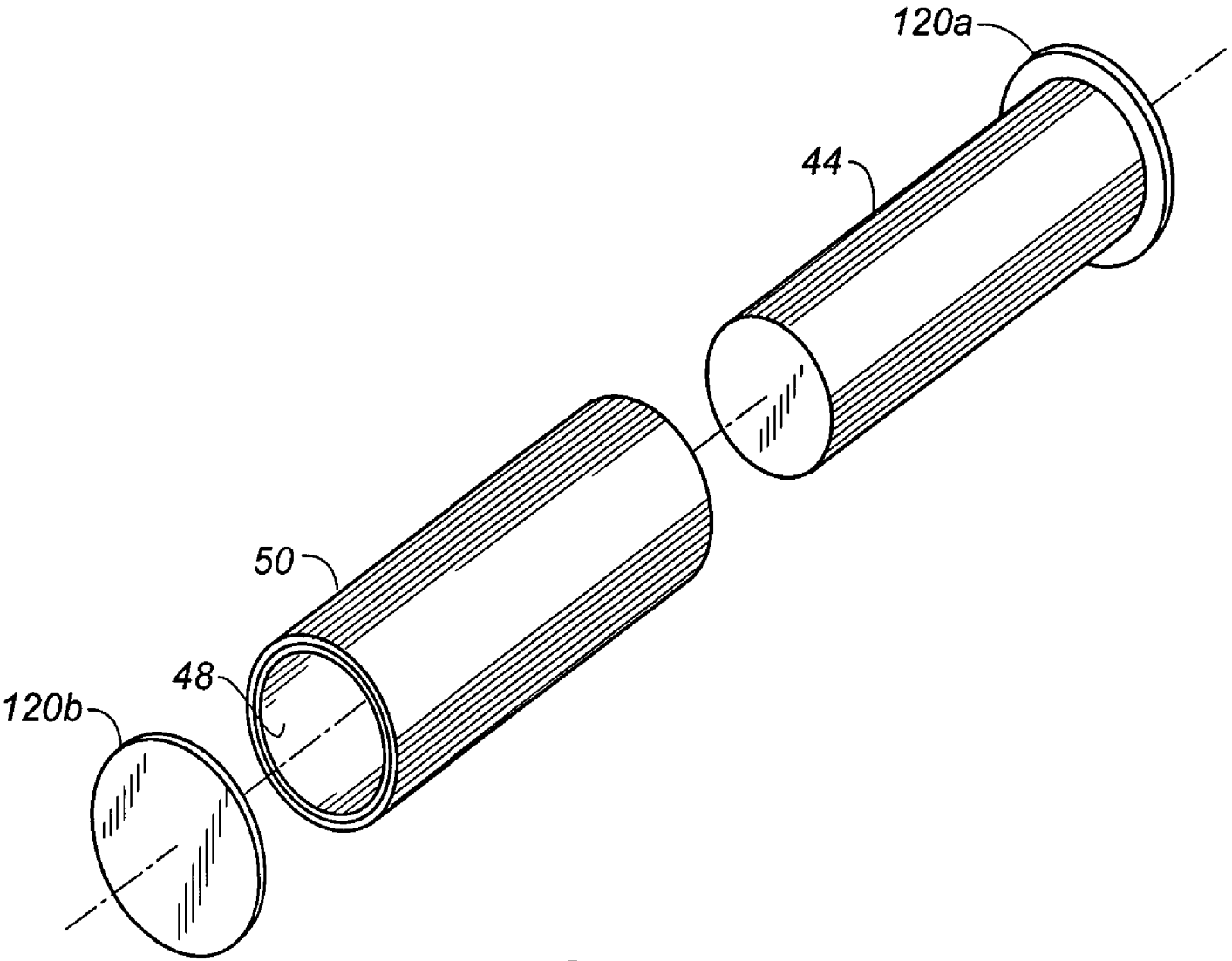
FIG. 4A is a perspective view illustrating one embodiment of a replacement sleeve in accordance with the present invention.
Figure 4B:
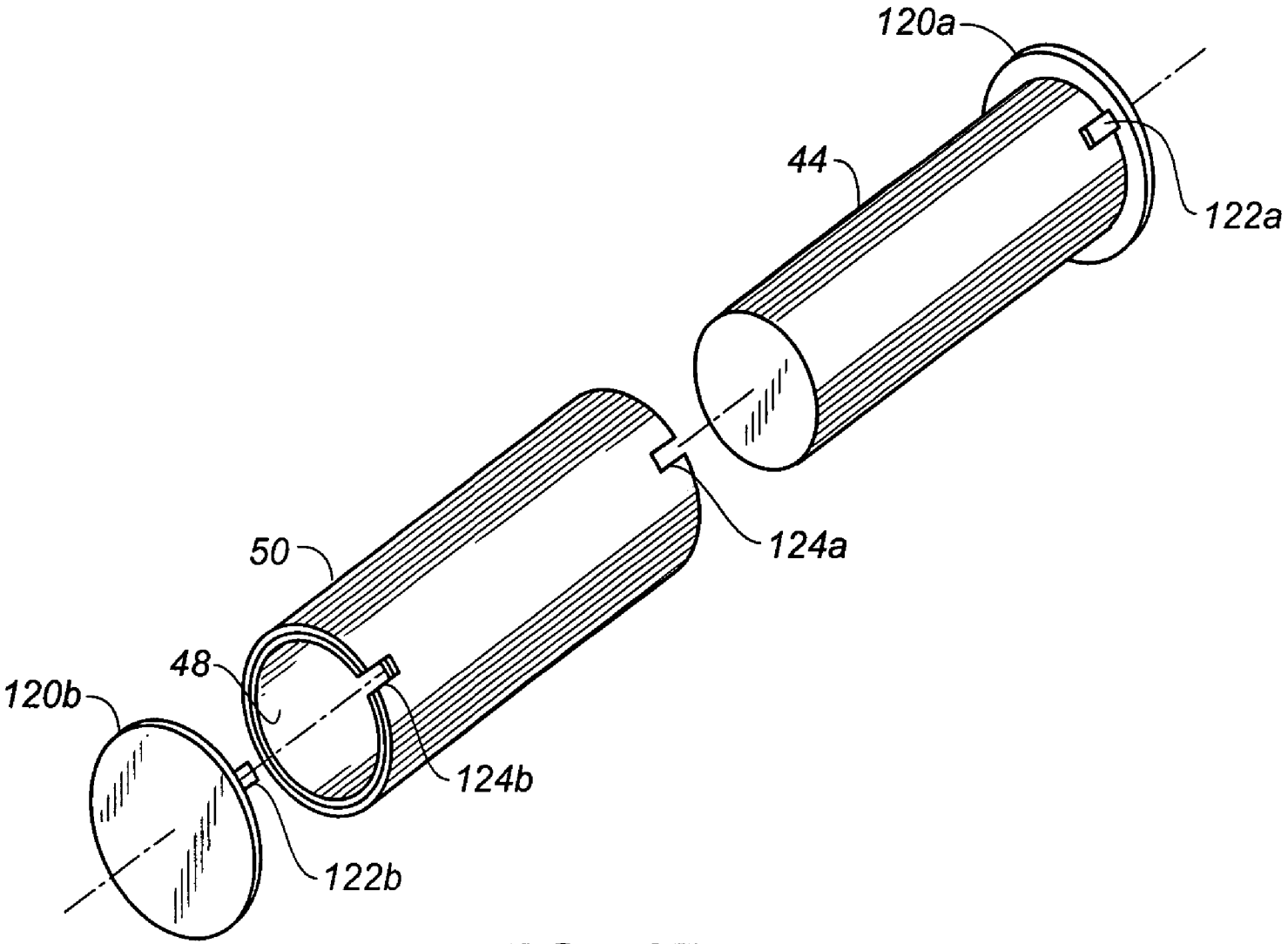
FIG. 4B is a perspective view illustrating one embodiment of a replacement sleeve in accordance with the present invention.
Figure 4C:
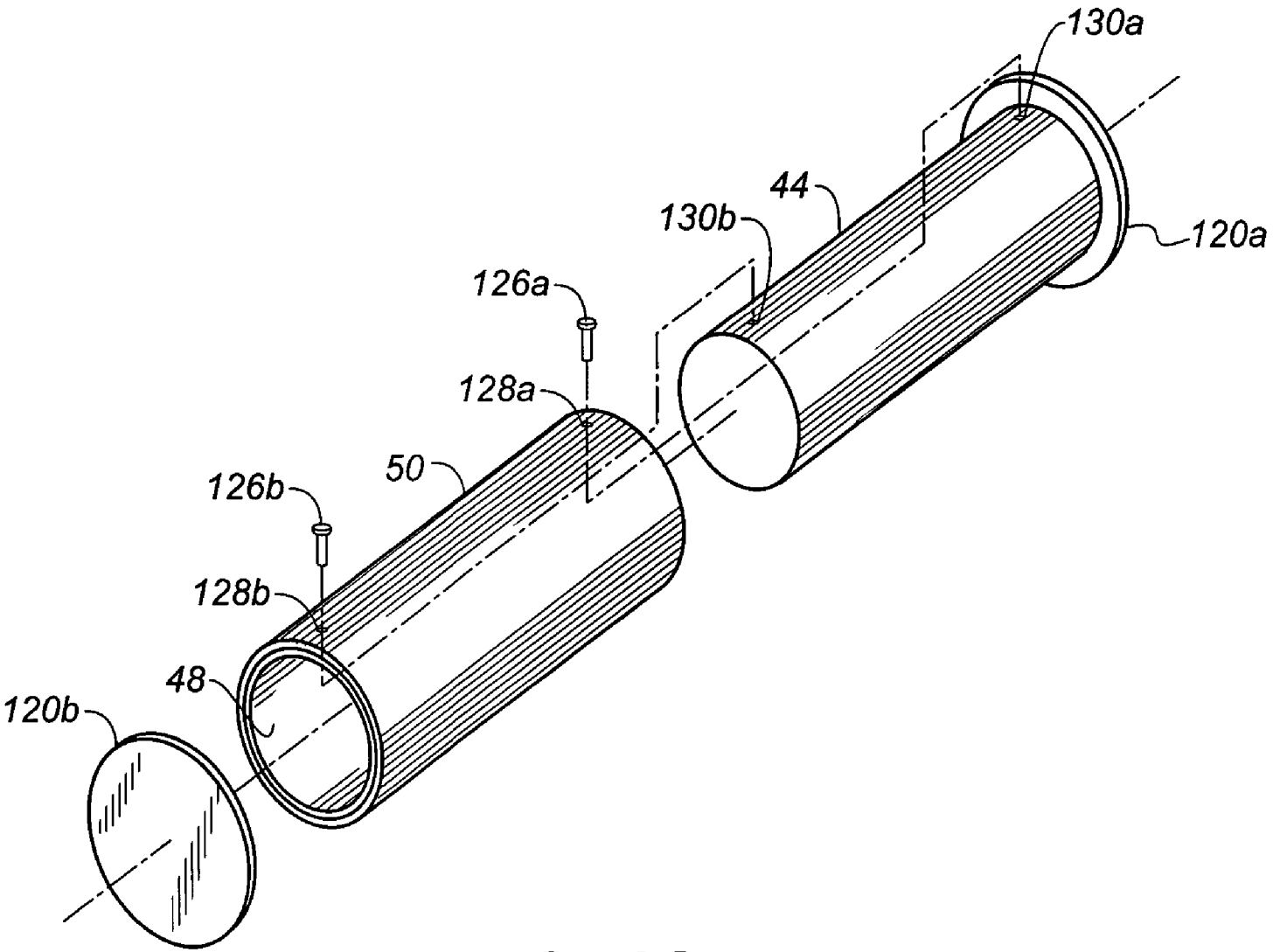
FIG. 4C is a perspective view illustrating one embodiment of a replacement sleeve in accordance with the present invention.

FIGS. 4A, 4B and 4C are perspective views illustrating generally the coupling of tubular sleeve 48 about the exterior surface of processor drum 44. As illustrated by FIG. 4A, a first end flange 120*a* is coupled to a first end of processor drum 44, which is in-turn coupled to drive system 34. While processor drum 44 and tubular sleeve 48 are cool (i.e. at an ambient temperature), tubular sleeve, which has an inner diameter incrementally larger than an outer diameter of processor drum 44, is slideably inserted and fitted about the outer surface of processor drum 44. A second end flange 120*b* is then coupled to a second end of processor drum 44, such that tubular sleeve 48 is retained between first and second end flanges 120*a* and 120*b*. In one embodiment, in order to improve the heat transfer characteristics, a coating of silicone fluid, or other thermal conduction material, is applied between the outer surface of processor drum 44 and inner surface of tubular sleeve 48. In one embodiment, for example, the fluid comprises Dow Corning 200™ high temperature silicon oil.

In one embodiment tubular sleeve 46 comprises a material having a rate of thermal expansion lower than a rate of thermal expansion of processor drum 44. In one embodiment, tubular sleeve 46 comprises nickel. In one embodiment, tubular sleeve 46 comprises a polycarbonate material. In one embodiment processor drum 44 comprises aluminum. As such, during operation, as thermal processor 30 is heated to a desired processing temperature by circumferential heater 42, an exterior diameter processor drum 44 expands at a rate greater than an interior diameter of tubular sleeve 46. As the temperature of processor drum 44 and sleeve 46 approach the desired processing temperature, the exterior surface of processor drum 44 expands to a diameter such that processor drum 44 engages and "captures" tubular sleeve 48 by creating a pressure fitting between itself and tubular sleeve 48. Tubular sleeve 48 and processor drum 44 are then in "intimate" contact with one another such that tubular sleeve 48 is interlocked with and rotates with processor drum 44 as it is driven by drive system 34. As such, in the embodiment illustrated generally by FIG. 4A, no mechanical fasteners are employed to secure tubular sleeve 48 to processor drum 44.

As illustrated by FIG. 4B, in one embodiment, first and second end flanges 120*a* and 120*b* include first and second tabs 122*a* and 122*b* which respectively correspond to notches 124*a* and 124*b* in tubular sleeve 48. As before, while tubular sleeve 48 and processor drum 44 are cool, tubular sleeve 48 is slideably inserted and fitted about the exterior of processor drum 44 such that tab 122*a* slides into and interlocks with corresponding notch 124*a*. Second flange 120*b* in then coupled to processor drum 44 such that tab 122*b* slides into and interlocks with corresponding notch 124*b*. In one embodiment, in addition to tabs 122 and notches 124, tubular sleeve 48 is interlocked with processor drum via the differing rates of thermal expansion between processor drum 44 and tubular sleeve 48 as described above with regard to FIG. 4A.

As illustrated by FIG. 4C, in one embodiment, tubular sleeve 48 is secured to processor drum 44 via use of one or more set screws 126. As illustrated, a pair of set screws 126*a* and 126*b* are employed. After being slideably inserted about the exterior of processor drum 44, tubular sleeve 48 is positioned such that holes a pair of holes, 128*a* and 128*b*, through polymer layer 50 and tubular sleeve 48 respectively align with a pair of corresponding threaded holes, 130*a* and 130*b*, in processor drum 44. Set screws 126*a* and 126*b* are respectively threaded into threaded holes 130*a* and 130*b* via holes 128*a* and 128*b* to secure tubular sleeve 48 to processor drum 44. In one embodiment, in addition to employing set screws 126*a* and 126*b*, tubular sleeve 48 is interlocked with processor drum via the differing rates of thermal expansion between processor drum 44 and tubular sleeve 48 as described above with regard to FIG. 4A.

Figure 6:
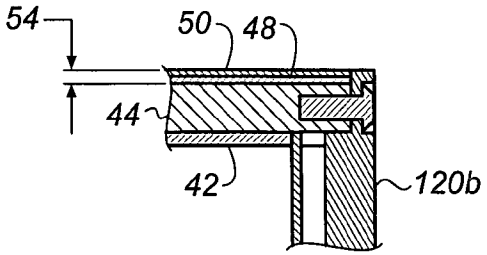
FIG. 6 is a cross-sectional view illustrating generally one embodiment of a thermal processor employing a replacement sleeve in accordance with the present invention.
Figure 5:
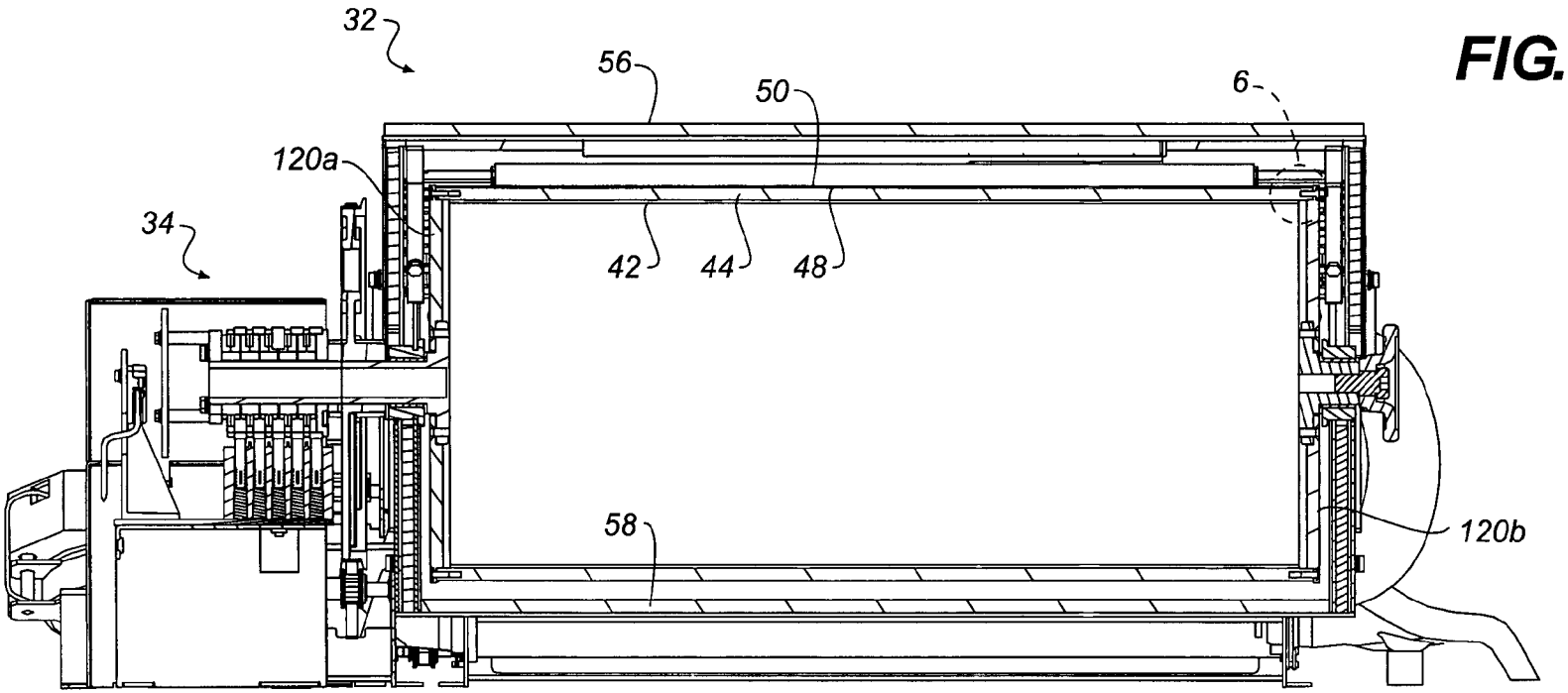
FIG. 5 is a cross-sectional view illustrating generally one embodiment of a thermal processor employing a replacement sleeve in accordance with the present invention.

FIG. 5 is a longitudinal cross-sectional view, as indicated by section line B-B at 141 in FIG. 1, illustrating portions of thermal processor 30 and indicates first end flange 120*a* being coupled to drive system 34. FIG. 6 is an enlarged view of portions of thermal processor 30 of FIG. 5 more clearly illustrating circumferential heater 42, processor drum 44, tubular sleeve 48, polymer material layer 50, and second end flange 120*b*. As illustrated, second end flange 120*b* is coupled to processor drum 44 via at least one screw 150 and retains tubular sleeve 48 about the exterior of processor drum 44.

Figure 7:
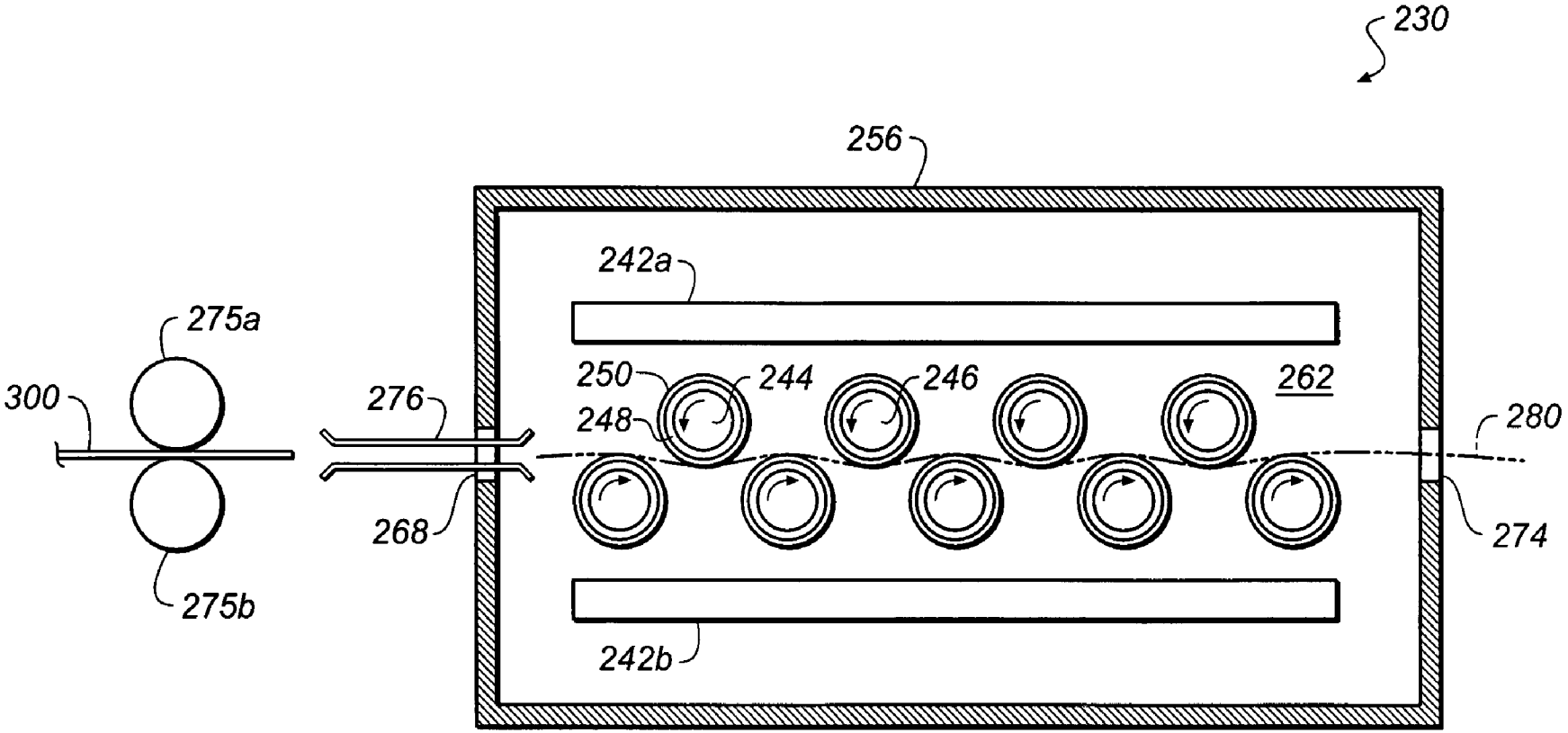
FIG. 7 is a cross-sectional view illustrating generally one embodiment.

FIG. 7 is a cross-sectional view illustrating generally another exemplary embodiment of a thermal processor 230 in accordance with the present invention. Thermal processor 130 is commonly referred to as a flat-bed type thermal processor and includes a plurality of rollers, such as roller 244, configured to rotate in a direction as indicated by directional arrow 246. A replaceable tubular sleeve 248 having an outer surface coated with a layer 250 of polymer material is positioned about and selectively coupled to an outer surface of rollers 246. An enclosure 256 forms an oven about roller 244 and tubular sleeves 256, the oven having an entrance 268 and an exit 274. An upper heat source 242*a* and a lower heat source 242*b* and 242*b* are configured to maintain oven 262 at a desired development temperature. A pair of feed rollers, 275*a* and 275, and a media guide 276 are positioned at entrance 268.

During operation, feed rollers 275*a* and 275*b* receive and feed a piece of exposed imaging media 300 to media guide 276. Media guide 276 in-turn channels exposed imaging media 300 into oven 262 via entrance 268. Polymer layer

250 contacts exposed imaging media, and the rotation 246 of rollers 244 and tubular sleeves 248 transport the exposed imaging media 300 through oven 262 along a sinusoidal-like transport path 280. As imaging media 300 travels along transport path 280 through oven 262, it is heated to the desired development temperature and, in the process, produces contaminants that over time can accumulate on surfaces within enclosure 256. In particular, these contaminants can accumulate on polymer layers 250 of tubular sleeves 248, which are in direct contact with imaging media 300. In a fashion similar to that described above by FIG. 2 with regard to thermal processor 30, a qualified technician can periodically replace tubular sleeves 248 in lieu of individually cleaning the outer surfaces of rollers 244.

By providing a removable sleeve coated with a layer of polymer material, the layer of polymer material can be replaced upon becoming contaminated with byproducts released by the imaging media during development by installing a new sleeve. Installation of a new sleeve eliminates problems associated with cleaning the integral polymer surfaces of standard processing drums, such as image defects resulting from nearly inherent variations in the cleanliness of the polymer material after cleaning and undesirable odors associated with cleaning solvents. Furthermore, replacement of the sleeve can be completed more quickly than cleaning the integral polymer surfaces of standard processor drums, thereby reducing labor associated with maintenance and processor downtime. Also, since the drum is not being replaced, calibration of associated heaters is not required.

All documents, patents, journal articles and other materials cited in the present application are hereby incorporated by reference.

The invention has been described in detail with particular reference to certain preferred embodiments thereof, but it will be understood that variations and modifications can be effected within the spirit and scope of the invention.

PARTS LIST

30 Thermal Processor
32 Heated Drum Assembly
34 Drive System
36 Film Cooling Section
38 Densitometer
40 Contaminant Removal System
41 Sectional View Indicator
42 Circumferential Heater
44 Heated Drum
46 Directional Arrow
48 Tubular Sleeve
50 Polymer Layer
52 Pressure Rollers
54 Thickness
56 Enclosure
58 Upper Cover
60 Lower Cover
62 Oven
64, 66 First Ends
68 Entrance Region
70, 72 Second Ends
74 Exit Region
75*a*, 75*b* Feed Rollers
76 Media Guide
77 Hinge
78 Film Diverter
80 Perforated Felt Pad
82 Upper Condensation Trap
84 Lower Condensation Trap
86 Flexible Duct
90 Vacuum System
92 Fan
94 Filter
96 Hose
100 Imaging Media
110, 112 Air Flow Direction
120*a*, 120*b* End Flanges
122*a*, 122*b* Tabs
124*a*, 124*b* Notches
126*a*, 126*b* Set Screws
128*a*, 128*b* Holes
130*a*, 130*b* Threaded Holes
141 Sectional View Indicator
230 Thermal Processor
256 Enclosure
262 Oven
268 Entrance
274 Exit
242*a*, 242*b* Upper and Lower Heat Sources
244 Rollers
246 Directional Arrow
248 Tubular Sleeve
250 Polymer Layer
275*a*, 275*b* Feed Rollers
276 Media Guide
280 Transport Path
300 Imaging Media

What is claimed is:

1. A thermal processor for thermally developing an image in an imaging material, the thermal processor comprising:

an oven;

at least one rotatable member positioned within the oven; and a sleeve adapted to slidably fit over and selectively couple to at least a portion of the rotatable member, the sleeve having an exterior surface coated with a layer of polymer material, wherein the sleeve is positioned such that the layer of polymer material contacts and transports the imaging material through the oven as the at least one rotatable member rotates;

wherein the sleeve comprises a material having high thermal conductivity characteristics; and wherein the layer of material comprises a silicone fluid applied to an exterior surface of the rotatable member prior to the sleeve being slideably fitted over the rotatable member.

2. The thermal processor of claim 1, wherein the sleeve is seamless.

3. The thermal processor of claim 1, wherein the sleeve is selectively coupled to the rotatable member with a removable fastener.

4. The thermal processor of claim 1, wherein the layer of polymer material comprises a silicone rubber polymer.

5. A thermal processor comprising:

an enclosure forming an oven;

a heated drum for thermally developing an image in an imaging media, the heated drum positioned at least partially within the oven;

a drive system for rotating the heated drum; and a tubular sleeve adapted to slidably fit over and selectively couple to at least a portion of an outer surface of the heated drum, the tubular sleeve having an exterior surface substantially coated with a polymer material, wherein the tubular sleeve is positioned such that the polymer material contacts the imaging media and transports the imaging material through the oven as the heated drum rotates;

wherein the sleeve comprises a material having high thermal conductivity characteristics sufficient to enable heat transfer from the heated drum to thermally develop the imaging-material, wherein the heated drum comprises a material having first coefficient of thermal expansion arid the tubular sleeve comprises a material having a second coefficient of thermal expansion, wherein the first coefficient of thermal expansion is greater than the second coefficient of thermal expansion, such that when the heated drum and tubular sleeve are heated to a temperature above a threshold temperature an outer diameter of the heated drum expands at a rate greater than an inner diameter of the tubular sleeve so that an exterior surface of the heated drum is in intimate contact with an inner surface of the tubular sleeve such that the tubular sleeve is secured to the heated drum without mechanical fasteners.

6. The thermal processor of claim 5, wherein the threshold temperature is less than a desired development temperature of the imaging media.

7. The thermal processor of claim 5, wherein the heated drum comprises an aluminum material.

8. A thermal processor comprising:

an enclosure forming an oven;

a heated drum for thermally developing an image in an imaging media, the heated drum positioned at least partially within the oven;

a drive system for rotating the heated drum; and a tubular sleeve adapted to slidably fit over and selectively couple to at least a portion of an outer surface of the heated drum, the tubular sleeve having an exterior surface substantially coated with a polymer material, wherein the tubular sleeve is positioned such that the polymer material contacts the imaging media and transports the imaging material through the oven as the heated drum rotates;

wherein the tubular sleeve comprises a material having high thermal conductivity characteristics sufficient to enable heat transfer from the heated drum to thermally develop the imaging-material;

wherein the tubular sleeve comprises nickel.

9. A thermal processor comprising:

an enclosure forming an oven;

a heated drum for thermally developing an image in an imaging media, the heated drum positioned at least partially within the oven;

a drive system for rotating the heated drum; and a tubular sleeve adapted to slidably fit over and selectively couple to at least a portion of an outer surface of the heated drum, the tubular sleeve having an exterior surface substantially coated with a polymer material, wherein the tubular sleeve is positioned such that the polymer material contacts the imaging media and transports the imaging material through the oven as the heated drum rotates;

wherein the tubular sleeve comprises a material having high thermal conductivity characteristics sufficient to enable heat transfer from the heated drum to thermally develop the imaging-material;

wherein the tubular sleeve comprises a polycarbonate material.

10. A thermal processor comprising:

an enclosure forming an oven;

a heated drum for thermally developing an image in an imaging media, the heated drum positioned at least partially within the oven;

a drive system for rotating the heated drum; and a tubular sleeve adapted to slidably fit over and selectively couple to at least a portion of an outer surface of the heated drum, the tubular sleeve having an exterior surface substantially coated with a polymer material, wherein the tubular sleeve is positioned such that the polymer material contacts the imaging media and transports the imaging material through the oven as the heated drum rotates;

wherein the heated drum has a first end and a second end and further includes a first flange selectively coupled to the first end and a second flange selectively coupled to the second end, the first and second flanges configured to retain the tubular sleeve about the heated drum.

11. The thermal processor of claim 10, wherein the first flange and the second flange each include a tab adapted to slideably insert into and interlock with a corresponding notch in the tubular sleeve.

12. The thermal processor of claim 10 wherein the tubular sleeve has a wall thickness of less than 0.1 inches.

13. The thermal processor of claim 10, wherein the wall thickness is 0.005 inches.

14. A thermal processor comprising:

an enclosure forming an oven;

a heated drum positioned within the oven for thermally developing an image in an imaging media;

means for rotating the heated drum;

means for selectively coupling a layer of polymer material about at least a portion of an exterior surface of the heated drum, the layer of polymer material positioned such that the polymer material contacts the imaging media and transports the imaging material through the oven as the heated drum rotates; and means for improving heat transfer from the heated drum to the layer of polymer materials, wherein the layer of polymer material comprises a material having high thermal conductivity characteristics sufficient to enable heat transfer from the heated drum to thermally develop the imaging media.

15. A thermal processor comprising:

an enclosure forming an oven;

a heated drum positioned within the oven for thermally developing an image in an imaging media, means for rotating the heated drum; and means for selectively coupling a layer of polymer material about at least a portion of an exterior surface of the heated drum, the layer of polymer material positioned such that the polymer material contacts the imaging media and transports the imaging material through the oven as the heated drum rotates;

further comprising: means for improving heat transfer from the heated drum to the layer of polymer material;

wherein means for improving heat transfer comprises providing a layer of silicone fluid between the exterior surface of the heated drum and the layer of polymer material.

* * * * *